US005551512A

United States Patent [19]

Smith

[11] Patent Number: 5,551,512

[45] Date of Patent: Sep. 3, 1996

[54] RUNNING TOOL

[75] Inventor: Sidney K. Smith, Conroe, Tex.

[73] Assignee: Baker Hughes Incorporated, Houston, Tex.

[21] Appl. No.: 376,910

[22] Filed: Jan. 23, 1995

[51] Int. Cl.[6] ..... E21B 23/00

[52] U.S. Cl. ..... 166/212; 166/319

[58] Field of Search ..... 166/212, 319, 166/320, 321, 208

[56] References Cited

U.S. PATENT DOCUMENTS

| | | | |
|---|---|---|---|
| 803,450 | 10/1905 | Stegner . | |
| 808,378 | 12/1905 | Johnston . | |
| 1,457,139 | 5/1923 | Bell et al. . | |
| 1,580,352 | 4/1926 | Ventresca . | |
| 1,619,254 | 3/1927 | Hart . | |
| 1,621,947 | 3/1927 | Moore . | |
| 1,638,494 | 8/1927 | Lewis et al. . | |
| 1,712,898 | 5/1929 | Newkirk . | |
| 1,728,136 | 9/1929 | Power . | |
| 1,779,123 | 10/1930 | Gates . | |
| 1,794,652 | 3/1931 | Stone . | |
| 1,815,462 | 7/1931 | Denney . | |
| 1,823,340 | 9/1931 | Vance . | |
| 1,917,135 | 7/1933 | Littell . | |
| 2,141,987 | 12/1938 | Jones . | |
| 2,290,409 | 7/1942 | Cuthill . | |
| 2,732,901 | 1/1956 | Davis . | |
| 2,806,534 | 9/1957 | Potts . | |
| 3,199,906 | 8/1965 | Chenoweth . | |
| 3,262,501 | 7/1966 | Winger . | |
| 3,638,989 | 2/1972 | Sandquist . | |
| 3,871,449 | 3/1975 | Ahlstone | 166/208 X |
| 4,273,372 | 6/1981 | Sheshtawy . | |
| 4,443,130 | 4/1984 | Hall . | |
| 4,616,721 | 10/1986 | Furse . | |
| 4,715,445 | 12/1987 | Smith, Jr. | 166/217 X |
| 4,928,769 | 5/1990 | Milberger et al. | 166/212 X |
| 4,949,786 | 8/1990 | Eckert et al. | 166/217 X |
| 5,145,006 | 9/1992 | June | 166/341 |
| 5,242,201 | 9/1993 | Beeman . | |

OTHER PUBLICATIONS

Drawing of Baker Oil Tool's 2RH Setting Tool (Non-Rotational), 1993.

Drawing of Baker Oil Tool's 'HR' Setting Tool (Hydraulic Release), 1993.

*Primary Examiner*—William P. Neuder

*Attorney, Agent, or Firm*—Rosenblatt & Redano, P.C.

[57] ABSTRACT

A running tool particularly useful for running liners on coiled tubing is disclosed. A torque-transmitting outer sleeve is employed which initially traps the collets. The collets are engaged to the liner by relative mechanical movement and thereafter lock in a secured position to the liner, regardless of whether the liner is placed in tension or compression by the running tool. Release is accomplished by letting down weight on the running tool, coupled with hydraulic pressure to shear a pin securing the collet mechanism. Upon such a hydraulic release with the pin sheared, the outer torque sleeve shifts downwardly to prevent relatching. Torque is transmitted through the outer torque sleeved and not through the latching collets.

18 Claims, 10 Drawing Sheets

RUNNING TOOL

FIELD OF THE INVENTION

The field of this invention relates to running tools, particularly those useful in running liners into wellbores on coiled tubing units.

BACKGROUND OF THE INVENTION

In the recent past, to save well operator time and money, coiled tubing units have been used in more applications as a substitute for rigid tubing. The coiled tubing facilitates shorter trips into and out of the wellbore, thus reducing rig time required for given operations. One of the operations that are now desirable for use with coiled tubing units is to run casing or liner into a wellbore. When using a coiled tubing unit to accomplish this operation, it is desirable to have a running tool which has features which retain a grip on the liner or casing, regardless of whether the liner or casing is in tension or compression. It is also desirable to be able to transmit torque to the liner to facilitate its advancement or retrieval from the wellbore. Another desirable feature is to be able to be sure that once there has been release from the liner that it does not again accidentally become reattached to the running tool. These desirable features have been combined into the apparatus which is the subject of the present invention.

In the past, various tools for gripping and releasing have been employed. Various tools have had a feature for mechanical actuation of engagement but were designed in such a manner so that if the object to which the running tool or fishing tool was engaged was put into compression, there would be a release. Typical of such tools is that disclosed in U.S. Pat. No. 5,242,201, which illustrates mechanical engagement by physical displacement of the collets against an object to be retrieved but which as well indicates a design which will release when placed in compression. The fishing tool illustrated in U.S. Pat. No. 5,242,201 also indicates the state of the known art regarding transmission of torque through the collets. In the design illustrated in U.S. Pat. No. 5,242,201, the collets are reinforced with lugs so that they can better withstand transmitted torque. On the other hand, the apparatus of the present invention makes it possible to transmit torque without involving the collets, which differs from the prior designs which put a torsional stress through the collets. Since the design in U.S. Pat. No. 5,242,201 is for a fishing tool where release and relatching to a stuck object to be retrieved is desirable, it did not provide for a feature that positively prevents relatching once there has been release from the object. In running liner on coiled tubing, relatching would be undesirable because it is industry standard to be free from your liner prior to pumping cement. Upon releasing the running tool, the drillpipe and running tool are picked up to verify its release and then set back down and put in compression. Then cement is displaced down through the drillpipe and up around the outside of the liner. If cement is overdisplaced, the cement can get up around the running tool. If the running tool is not released, this could cause a problem.

Accordingly, the apparatus of the present invention represents an improvement over known devices. Particularly for operations involving running liner with coiled tubing, the apparatus provides a mechanism to retain the liner whether it is in tension or compression under application of fluid pressure to the tool, to transmit torque directly through the liner outside the collets, and to positively stay released from the liner once steps have been taken to deliberately release from the liner.

SUMMARY OF THE INVENTION

A running tool particularly useful for running liners on coiled tubing is disclosed. A torque-transmitting outer sleeve is employed which initially traps the collets. The collets are engaged to the liner by relative mechanical movement and thereafter lock in a secured position to the liner, regardless of whether the liner is placed in tension or compression by the running tool. Release is accomplished by letting down weight on the running tool, coupled with hydraulic pressure to shear a pin securing the collet mechanism. Upon such a hydraulic release with the pin sheared, the outer torque sleeve shifts downwardly to prevent relatching. Torque is transmitted through the outer torque sleeve and not through the latching collets.

DETAILED DESCRIPTION OF THE PREFERRED EMBODIMENT

Figure 1A:
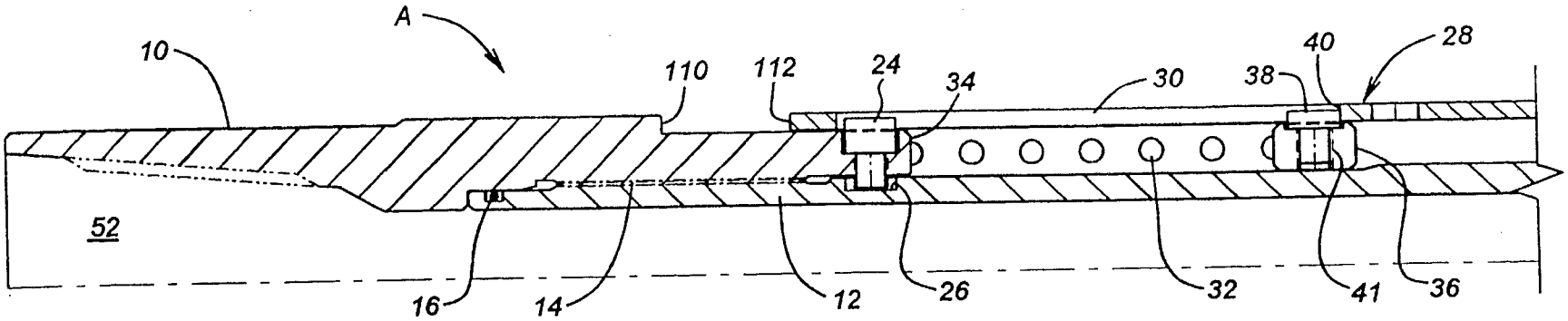
FIG. 1 is a sectional elevational view of the apparatus in the run-in position upon initial engagement with the liner.

The apparatus A is illustrated in FIG. 1. A top sub 10 is connected to a mandrel 12 at thread 14, with the connection sealed by seal 16. Mandrel 12 is connected to bottom sub 18 at thread 20 which is sealed by seal 22. A guide lug 24 is secured to top sub 10 and extends into groove 26 of mandrel 12.

Figure 8:
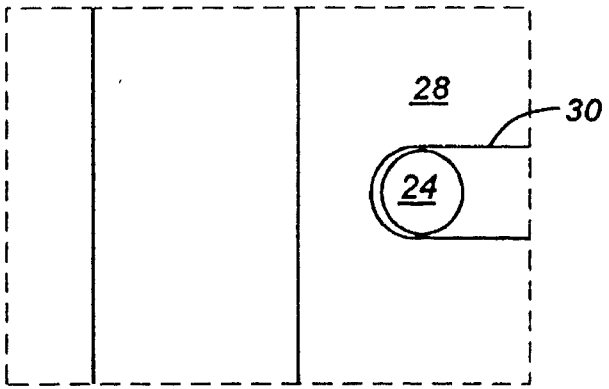
FIG. 8 is a detail showing the guide mechanism for the torque sleeve to transmit torque from the apparatus directly to the liner.

A torque sleeve 28 has a window 30 in the form of a long longitudinal slot, through which extends lug 24. Accordingly, rotational forces applied to top sub 10 are transmitted to torque sleeve 28 through lug 24. At the same time, relative longitudinal motion is possible between top sub 10 and torque sleeve 28 as will be described below. It should be noted that FIG. 8 illustrates a detail of the arrangement, showing torque sleeve 28 with its window 30 and lug 24 extending therethrough.

A spring 32 bears on lower end 34 of top sub 10. Ring 36 is mounted between mandrel 12 and torque sleeve 28. Its relative position is secured due to a lug 38 extending through bore 40, which is oriented radially in ring 36. Since, as shown in FIG. 1 lug 38 extends into window 30, the lug 38 can travel no further than the position shown in position la when lug 38 hits the bottom 40 of window 30. Accordingly, spring 32 exerts a downward force on torque sleeve by pushing down on ring 36 when lug 38 is bottomed on window 30.

Mounted over mandrel 12 is sleeve 42. Sleeve 42 forms a variable-volume cavity 44, which is in turn sealed by seals 46 and 48. A passageway 50 connects the central bore 52 with variable-volume cavity 44. Sleeve 42 is connected to ring 54 at thread 56. Ring 54 is connected to sleeve 58 at thread 60. Sleeve 58 has an outwardly oriented shoulder 62 which is at times engageable with ring 64, as will be described below. The collet assembly 66 is connected to ring 64 at thread 68. The collet assembly 66 features an inwardly oriented shoulder 70, a plurality of collet fingers 72, each of which terminate in a collet head 74. The collet heads 74 are formed by surfaces 76-86. The torque sleeve 28 has a lower end 88, which has a series of castellations 90. Castellations 90 can be better seen in FIG. 9.

Figure 1B:
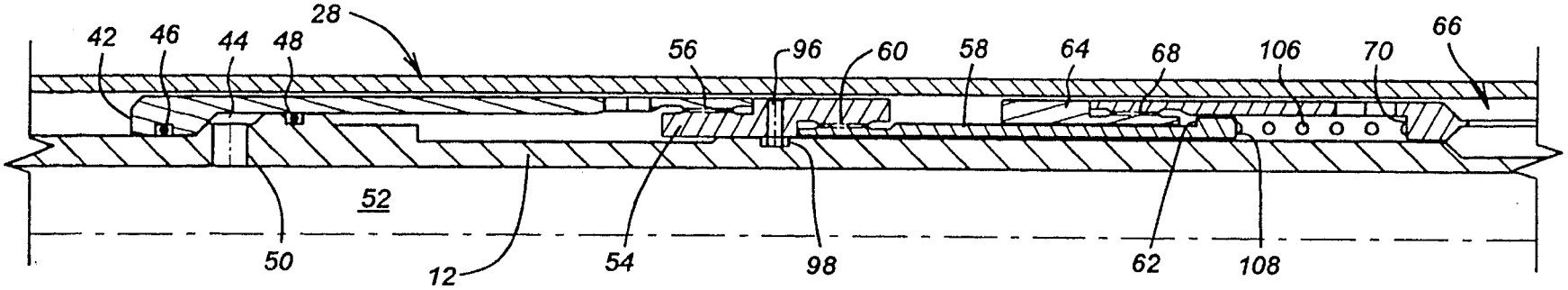
Figure 1C:
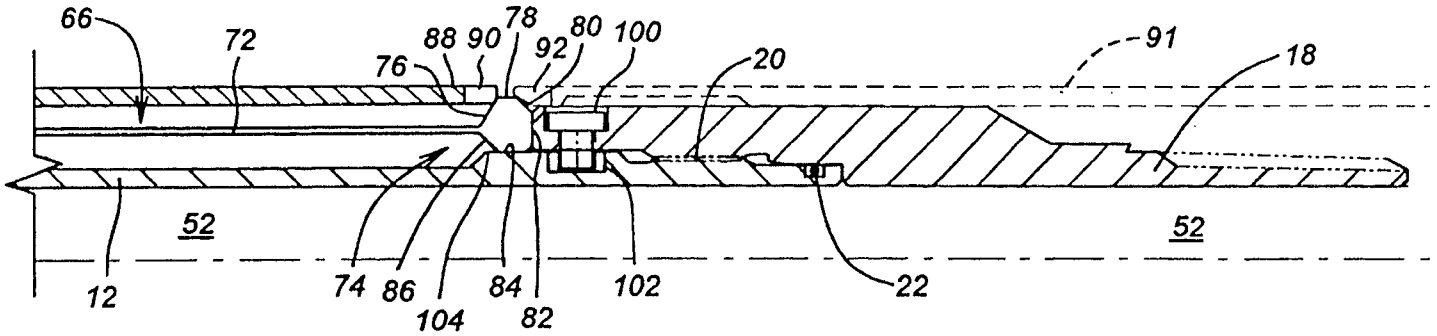

The casing or liner is shown in dotted lines in FIG. 1*c* as 91. It has an upper end 92 with castellations 94. The castellations 94 can be better seen in FIG. 9. Those skilled in the art will appreciate that when the torque sleeve 28 engages the liner or casing 91, there is an interengagement between the castellations 90 and 94 to allow for transmission of torque therethrough.

It should be noted that the position of ring 54 illustrated in FIG. 1*b* is maintained by a shear pin 96 which extends through ring 54 and into groove 98 of mandrel 12. As will be explained below, when the shear pin 96 is sheared, ring 54 is able to move relatively with respect to mandrel 12 to facilitate release from the liner 91. Finally, as shown in FIG. 1*c*, the mandrel 12 is secured to the bottom sub 18 by the engagement of thread 20. A lug 100 extends through bottom sub 18 and into mandrel 12 into groove 102.

Figure 2A:
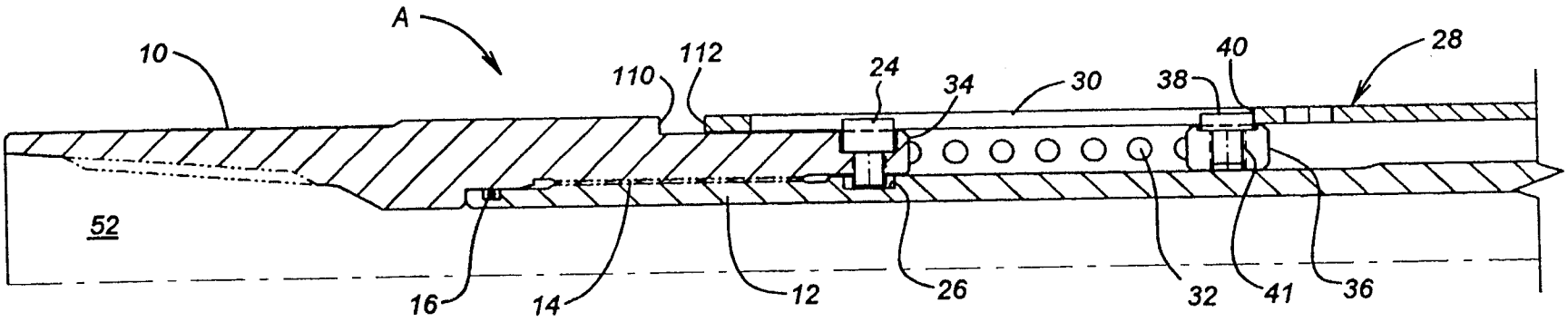
FIG. 2 is the apparatus of FIG. 1 showing the collets becoming unsupported.
Figure 2B:
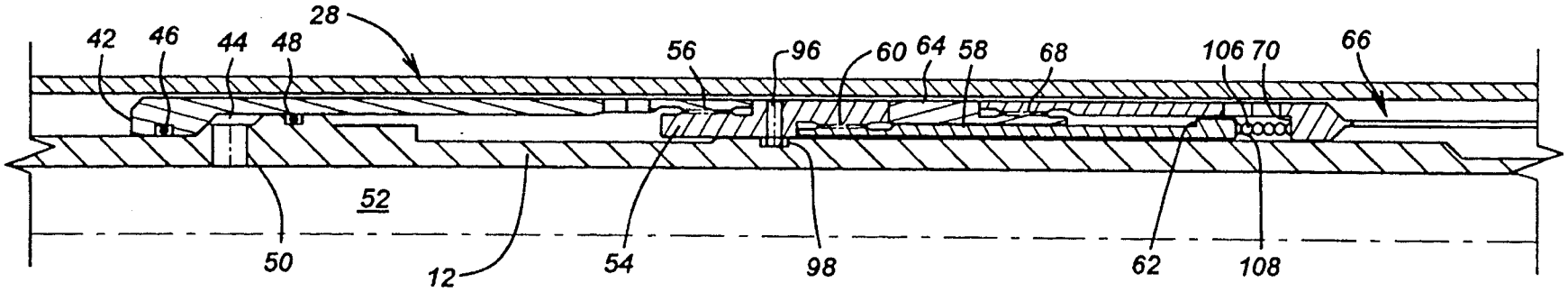
Figure 2C:
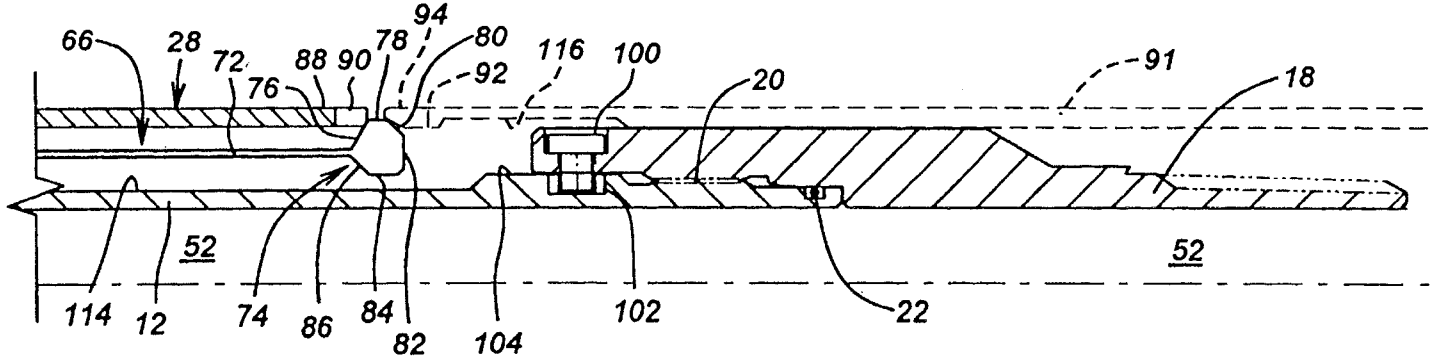

All the major components now having been described, the operation of the apparatus A of the present invention will be explained. The apparatus A is aligned and inserted into the liner 91 to be run in the wellbore. At that time, as illustrated in FIG. 1*c*, the torque sleeve 28 is biased downwardly by spring 32. The torque sleeve 28 in turn bears down on surface 76 of the collet heads 74, while at the same time mandrel 12 presents raised surface 104 adjacent surface 84 of the collet heads 74 to effectively trap the collet heads 74. Upon the increase in force exerted on top sub 10, as illustrated by comparing FIG. 2 to FIG. 1, the mandrel 12 with bottom sub 18 move downwardly, while the collet heads 74 remain immobilized due to torque sleeve 28 bearing down on surface 76 of collet heads 74, while at the same time the upper end 92 of liner 91 is in contact with surface 80 of the collet heads 74, thus further preventing their downward movement. In order to allow the mandrel 12 to move downwardly while the collet heads 74 remain in a stationary position, spring 106 is compressed between shoulders 70 and 108 (see FIG. 2*b*). In effect, shoulder 108 moves closer to shoulder 70 to compress spring 106, while at the same time shoulder 110 advances toward upper end 112 of torque sleeve 28 (see FIG. 2*a*). By comparing the positions in FIGS. 1 and 2, it can be seen that the downward shifting of the assembly of top sub 10, mandrel 12, and bottom sub 18, results in movement of raised surface 104 away from surface 84, thus making the collet heads 74 unsupported. As soon as that occurs, spring 106 is able to move the collet assembly 66 by pushing on shoulder 70. The collet heads 74 move inwardly temporarily toward depressed surface 114, which is a recessed surface on mandrel 12 which is now presenting itself opposite surface 84 (see FIG. 2*c*). Spring 106 further translates the collet heads 74 longitudinally around the upper end 94 of the liner 91 until the surface 78 of the collet heads 74 enters groove 116 of liner 91. At that time, as shown in FIG. 3*c*, the collet heads 74 once again become trapped, this time in groove 116 when raised surface 104 is once again presented against surface 84 on the collet heads 74. A lifting force, such as applied in the position shown in FIG. 3, will allow lifting of the liner 91 since the collet heads 74 are firmly engaged in groove 116. Similarly, a downward force on the top sub 10, as shown in FIG. 4, will still not result in a release of the collet heads 74 from groove 116 since they will still remain trapped by the juxtaposition of raised surface 104 with surface 84.

Figure 3A:
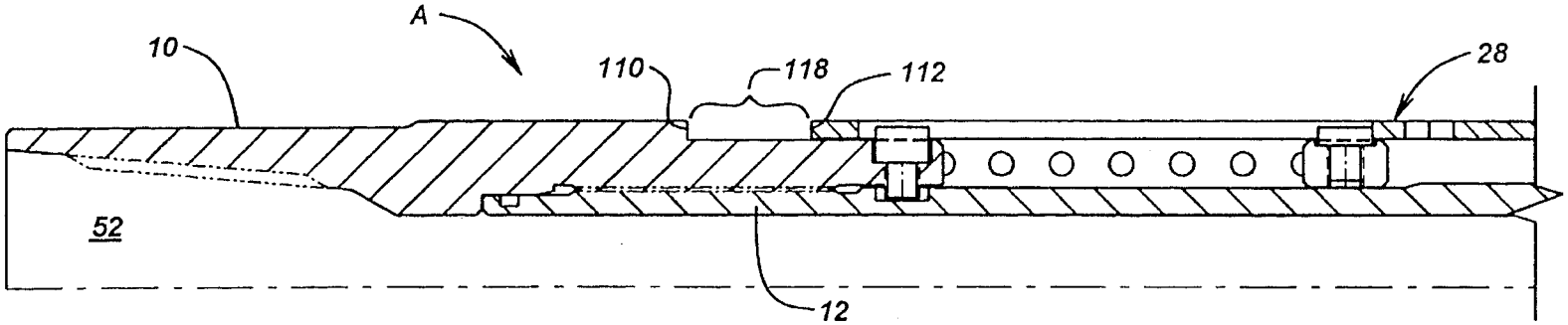
FIG. 3 is the view of FIG. 2 showing the collets engaging the groove in the liner and locking against it.
Figure 4A:
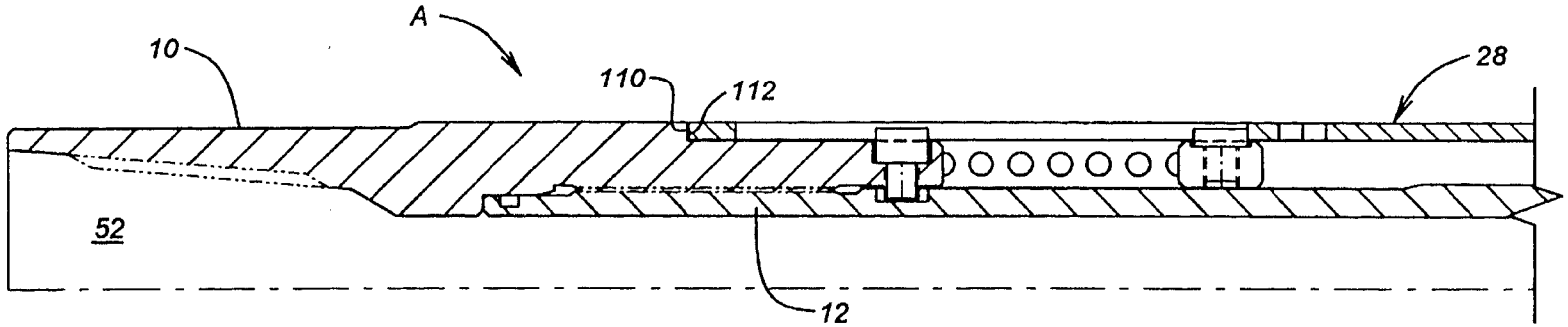
FIG. 4 is the view of FIG. 3 with weight shifted down on the apparatus, showing how the collets continue to retain their locking engagement with the liner.
Figure 3B:
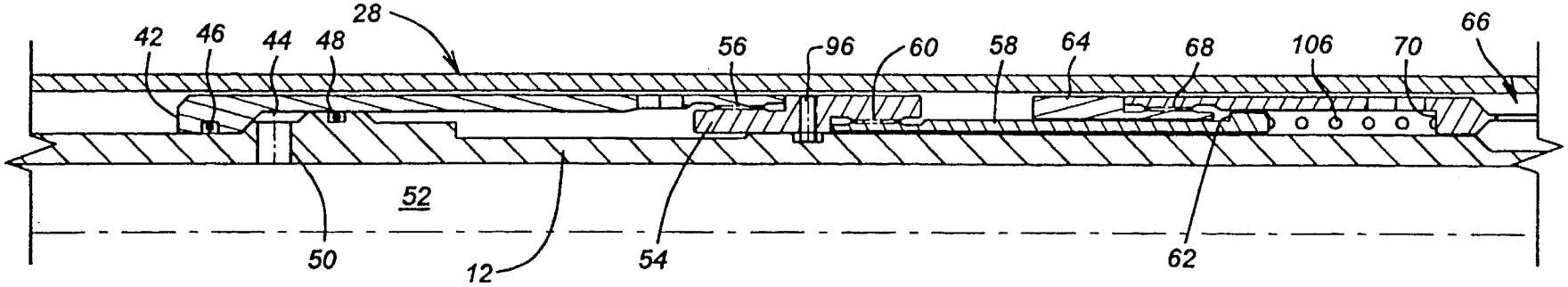
Figure 4B:
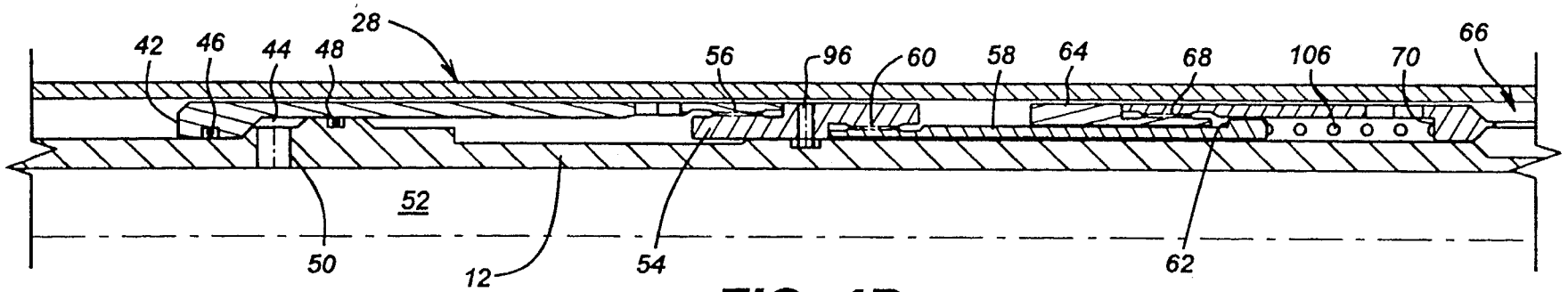
Figure 3C:
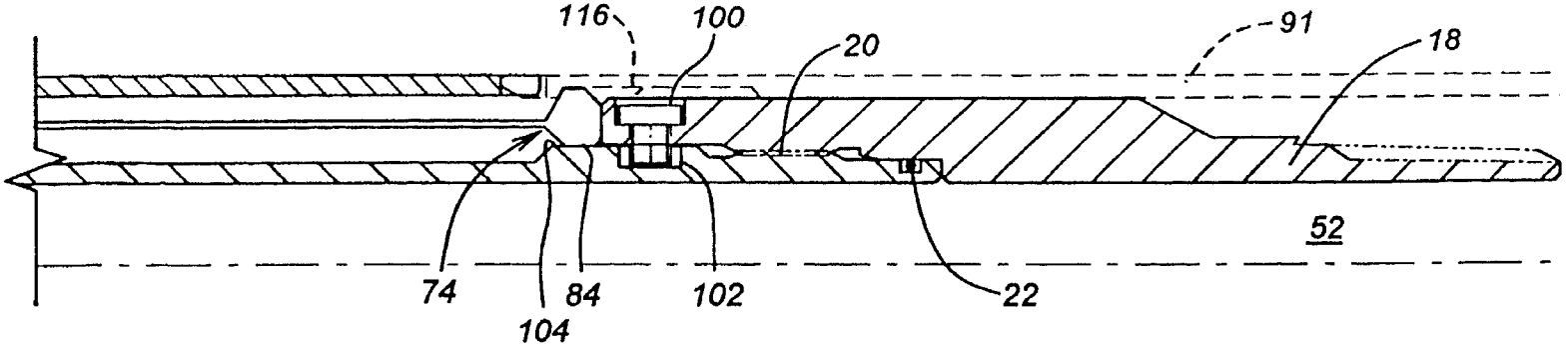
Figure 4C:
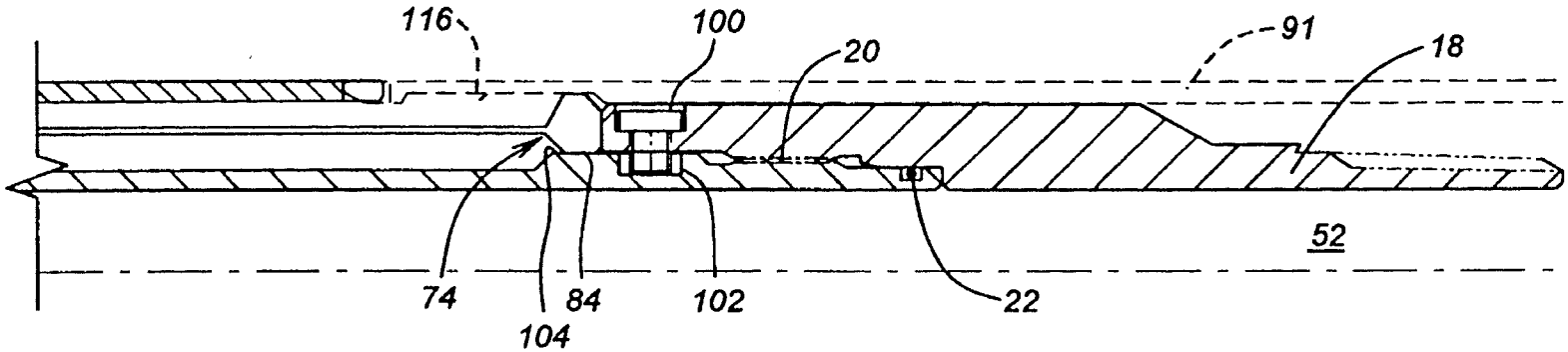

As shown in FIG. 3*a*, gap 118 between shoulder 110 and upper end 112 is a predetermined distance shorter than the length of groove 116. Accordingly, when downward weight is put on top sub 10, as shown in FIG. 4, shoulder 110 bottoms on torque sleeve 28 at its upper end 112. However, throughout the movement which brings shoulder 110 closer to top end 112, collet heads 74 move in tandem with mandrel 12 due to shear pin 96, which ties the movement of mandrel 12 to ring 54. While the movement is occurring, which is shown in FIG. 4, there is no resistance to advancement of collet heads 74 within groove 116. Accordingly, when ring 54 moves downwardly with mandrel 12, it pushes down on sleeve 58, which in turn transmits the movement through spring 106 to collet assembly 66. As a result, by looking at FIGS. 3*c* and 4*c*, the relative positions of collet heads 74 and raised surface 104 remain unchanged in the movement from the position shown in FIG. 3 to the position shown in FIG. 4.

Figure 5A:
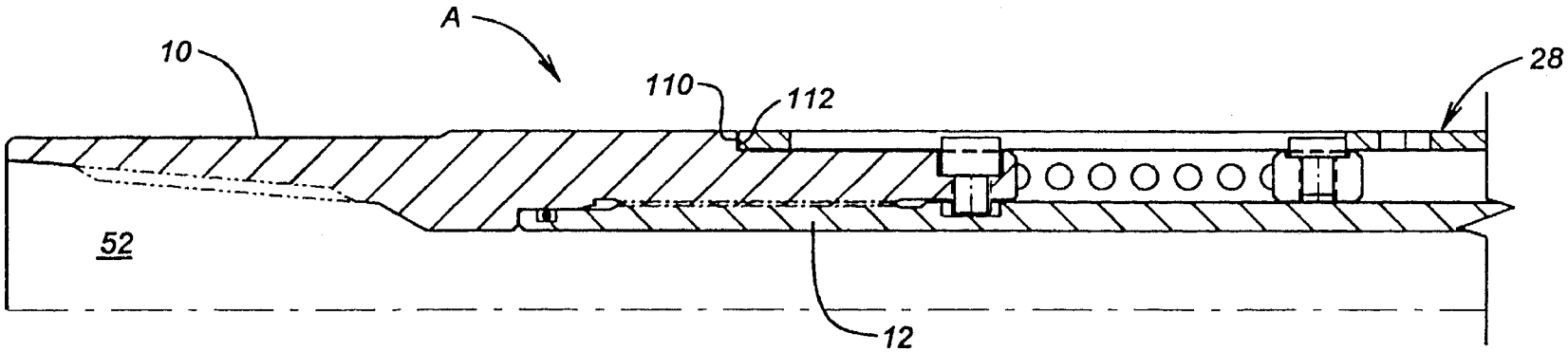
FIG. 5 is the view of FIG. 4 with hydraulic pressure applied to the apparatus to obtain release of the collets from the liner.
Figure 6A:
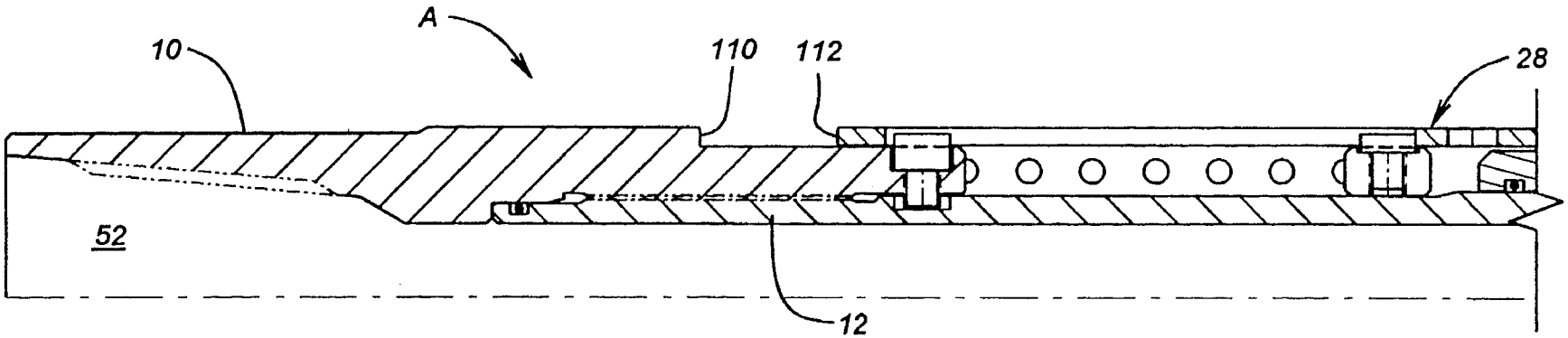
FIG. 6 is the view of FIG. 5 with an upward force applied to the apparatus, illustrating how the collets cannot relatch against the liner.
Figure 5B:
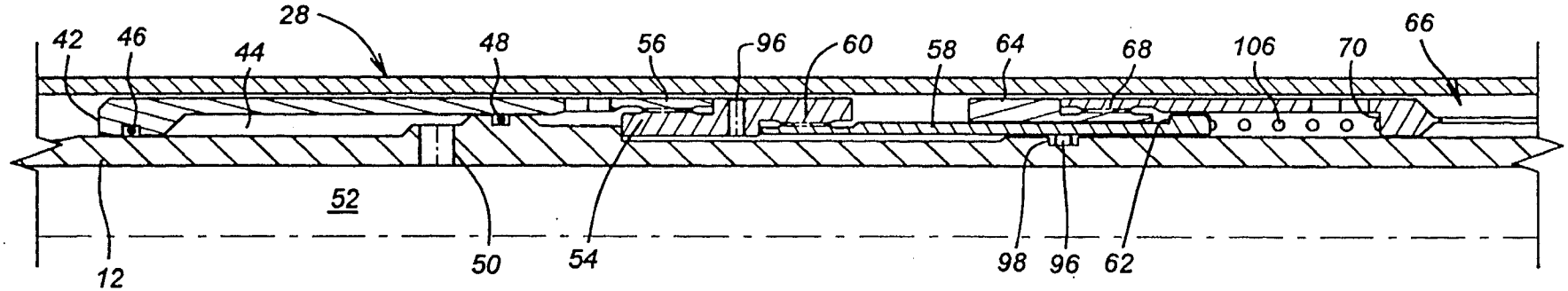
Figure 6B:
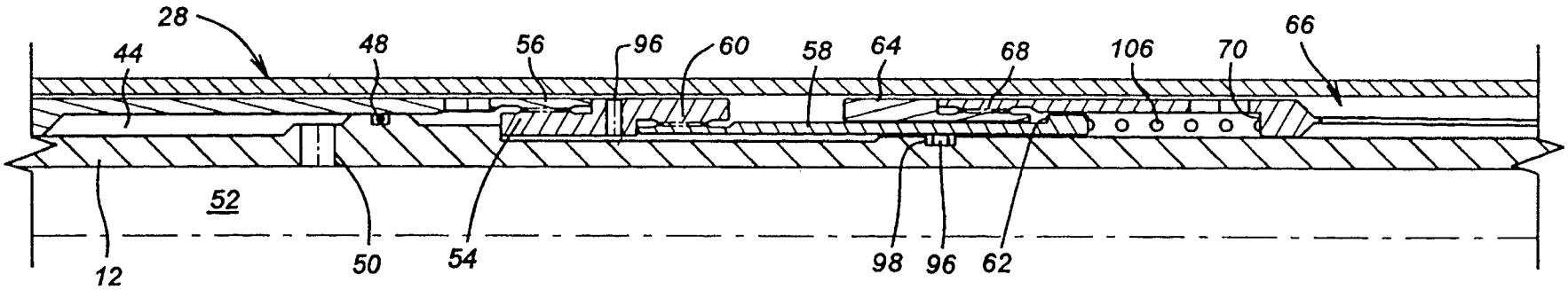
Figure 5C:
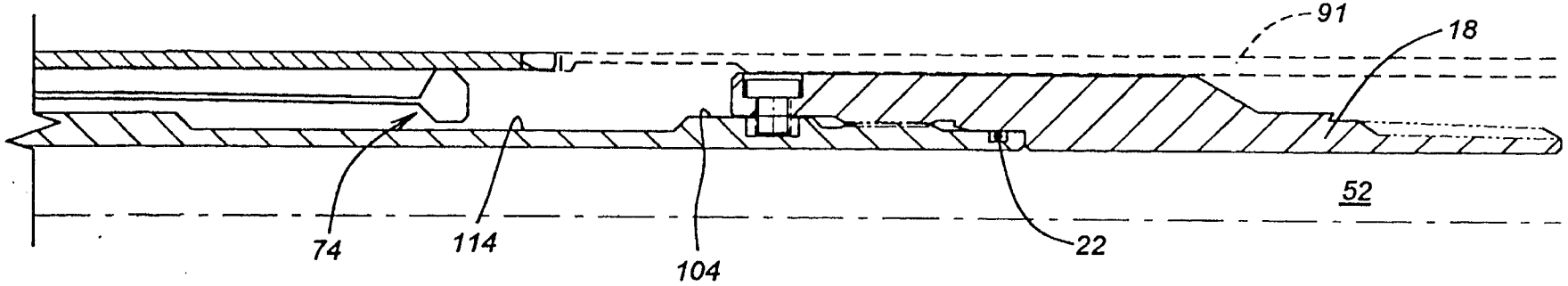
Figure 6C:
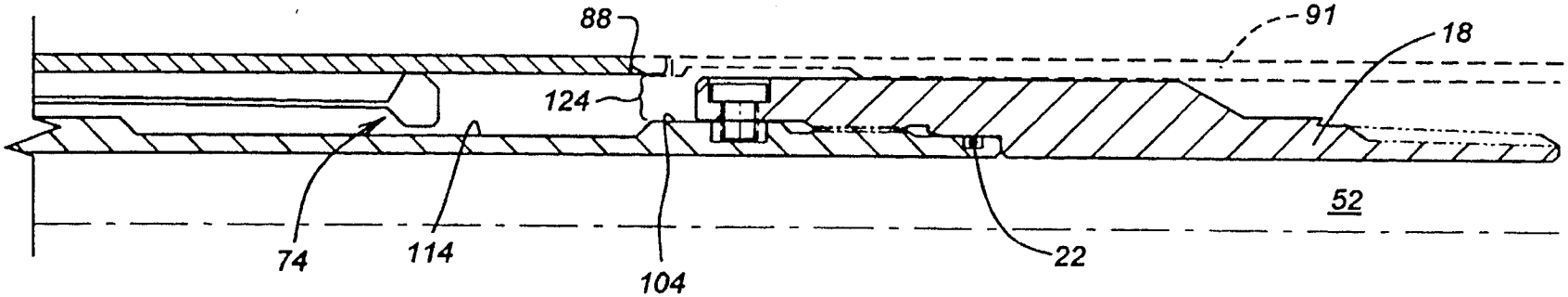
Figure 7:
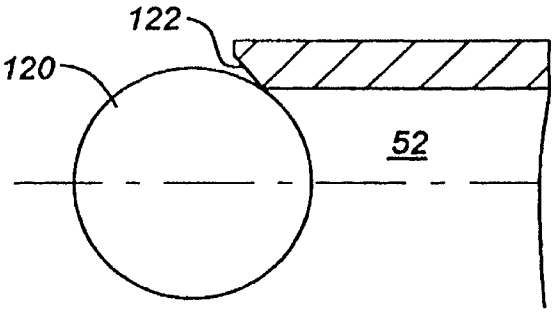
FIG. 7 is a detailed view showing how pressure is built up in the apparatus by dropping a ball against the seat.

When it is desired to release from the liner 91, a downward force is applied to top sub 10. At that time, a ball 120 (see FIG. 7) is dropped into sealing engagement with seat 122. Seat 122 is located at or below bottom sub 18 in bore 52. Once ball 120 is seated against seat 122, pressure from the surface can be built up in bore 52. Other pressure build-up techniques can be used, such as an orifice which creates backpressure when sufficient flow is pumped through it. This pressure is communicated through passage 50 to increase the volume of variable-volume cavity 44. In so doing, the shear pin 96 is sheared while the hydraulic pressure pulls up sleeve 42, which takes up with it ring 54 as well as sleeve 58. Eventually, shoulder 62 bottoms on ring 64, thus applying an upward pull to the collet assembly 66 because ring 64 is threadedly connected to collet assembly 66 at thread 68. Because a downward force on top sub 10 is applied from the surface while at the same time hydraulic pressure increases the volume of variable-volume cavity 44, collet heads 74 can escape the groove 116 because once again in that position, the recessed surface 114 presents itself in opposition to groove 116. The upward force which is ultimately transmitted to the collet heads 74 retracts them to the position shown in FIG. 5*c*. Thereafter, the downward force on top sub 10 is removed and an upward force is placed on top sub 10. When this occurs, shoulder 110 moves away from top end 112 while spring 32, which had been previously compressed in the view shown in FIG. 5*a*, now relaxes, pushing downwardly on torque sleeve 28. Torque sleeve 28, as shown in FIG. 6*c*, moves downwardly so that its lower end 88 comes into alignment with raised surface 104, while the collet heads 74 are further retracted against recessed surface 114. With the shear pin 96 having already been sheared, any further setdown force on top sub 10 will only accomplish retraction of torque sleeve 28. Seals 46 and 48 create sufficient resistance to downward movement of sleeve 42 so that collet heads 74 remain within torque sleeve 28 to prevent reengagement. Gap 124 is also sufficiently narrow to prevent escape of collet heads 74 with torque sleeve 28 in a fully biased position by spring 32.

Figure 9:
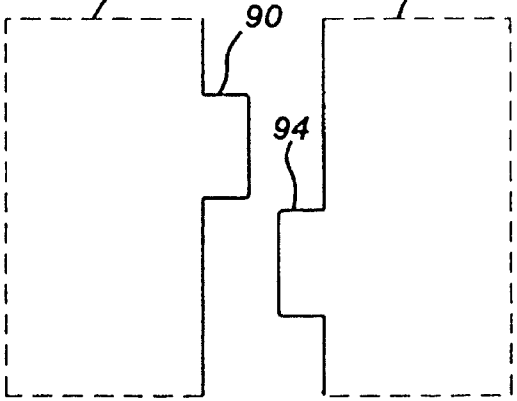
FIG. 9 is a detailed view of the castellations which appear at the lower end of the torque sleeve as well as the upper end of the liner section which are used to transmit torque through the apparatus and into the liner.

It should be noted that when the torque sleeve 28 engages the liner 91, the castellations 90 and 94 can engage in an offset manner as shown in FIG. 9, which is the preferred mode to allow the transmission of torque therethrough. If desired and the transmission of torque is for any reason not important, the torque sleeve 28 can engage the liner 91 in such a manner that the castellations 90 and 94 are in alignment as opposed to the offset in which they are shown in FIG. 9. Engagement can still occur between the apparatus A and the liner 91 with the castellations 90 and 94 in alignment. However, upon application of any torque, the castellations 90 and 94 will snap into an interengaging orientation, as shown in FIG. 9. While a ball 120 dropping against a seat 122 has been shown as the mechanism to obstruct the central bore 52, other ways to close off this bore or to build up hydraulic pressure can be employed without departing from the spirit of the invention.

Those skilled in the art will now appreciate that with the components and movements described above, an apparatus A is revealed which can engage a liner and retain the engagement, regardless of whether the running tool is subjected to a pulling or a pushing force with respect to the liner. Additionally, torque can be transmitted to the liner 91 outside the locking mechanism or the collet heads 74. The torque sleeve 28 transmits the torque directly from the top sub 10 to the liner 91. A provision is made for relative movement between torque sleeve 28 and top sub 10, which is smaller than the length of the groove in the liner 91 which is to be engaged. Therefore, regardless of whether the collet heads 74 are in tension or compression, as shown in FIGS. 3 and 4, respectively, the engagement is retained. The fluid pressure release, once accomplished, becomes permanent as the torque sleeve 28 is repositioned by the force of spring 32 downwardly a sufficient distance to juxtapose itself next to raised surface 104 on the mandrel, effectively creating a gap 124 small enough to prevent collet heads 74 from getting any further engagement into groove 116. Torque sleeve 28 actually covers collet heads 74 in this released position to further ensure that liner 91 is not teengaged. It should be noted that until the bore 52 is obstructed with ball 120, the engagement to the liner 91 is retained. It is only when it is deliberately decided that it is time to let go of the liner 91 that the bore 52 is obstructed, allowing pressure build-up in cavity 44 to effectuate the shearing of shear pin 96 for the release and subsequent lock-out feature which will prevent reengagement. Accordingly, in one simple, low-profile tool, a variety of functions are accomplished. Compact design is important due to the small size requirements for such running tools, particularly in deviated well-bores. Those skilled in the art will appreciate that the apparatus A can, of course, also be used as a retrieving tool or a fishing tool. The unique layout of parts illustrated in the preferred embodiment allows all these features to be present in the apparatus A while still allowing the tool to fit through openings as small as 3½" or smaller.

The foregoing disclosure and description of the invention are illustrative and explanatory thereof, and various changes in the size, shape and materials, as well as in the details of the illustrated construction, may be made without departing from the spirit of the invention.

I claim:

1. A running tool for downhole tubulars, comprising:

a body;

a gripping member on said body, selectively engageable with a groove on the tubular, said gripping member, once engaged to the groove on the tubular, retaining its grip whether the tubular is placed in tension or compression, or under a torque by said body;

a releasing device on said body to defeat the grip of the gripping member.

2. The tool of claim 1, further comprising:

a torque member on said body, engageable to the tubular in a manner to allow direct torque transmission from said body to the tubular without appreciable transmission of torque stresses through said gripping member.

3. The tool of claim 2, wherein:

said gripping member, once defeated by said releasing device, is precluded from obtaining a new grip on the tubular groove by said torque member.

4. The tool of claim 3, wherein:

said gripping member comprises at least one collet;

said body comprises a raised surface and an adjacent depressed surface;

said torque member selectively retaining said collet against said raised surface until mechanical engagement of said collet with the tubular facilitates translation of said body with respect to said collet until said depressed surface is adjacent said collet.

5. The tool of claim 4, wherein:

said torque member comprises a biased sleeve mounted over said body and having an interengaging mechanism at a lower end thereof to engage the tubular for direct torque transmission through said torque sleeve.

6. A running tool for downhole tubulars, comprising:

a body;

a gripping member on said body, selectively engageable with a groove on the tubular, said gripping member, once engaged to the groove on the tubular, retaining its grip whether the tublular is placed in tension or compression, or under a torque by said body;

a releasing device on said body to defeat the grip of the gripping member;

a torque member on said body, engageable to the tubular in a manner to allow direct torque transmission from said body to the tubular without appreciable transmission of torque stresses through said gripping member;

said gripping member, once defeated by said releasing device, is precluded from obtaining a new grip on the tubular groove by said torque member;

said gripping member comprises at least one collet;

said body comprises a raised surface and an adjacent depressed surface;

said torque member selectively retaining said collet against said raised surface until mechanical engagement of said collet with the tubular facilitates translation of said body with respect to said collet until said depressed surface is adjacent said collet;

said torque member comprises a biased sleeve mounted over said body and having an interengaging mechanism at a lower end thereof to engage the tubular for direct torque transmission through said torque sleeve;

said collet is biased, off of a temporary support mounted to said body, in the same direction as said bias on said torque sleeve; and said releasing device further comprises a pressure-actuated sleeve that undermines said temporary support and translates said collet toward said depressed surface on said body for release from the tubular.

7. The tool of claim 6, wherein:

said pressure-actuated sleeve creates a sealed variable-volume cavity between itself and said body;

said body having a port connecting said cavity with a passage in said body;

means for creating pressure in said passage to translate said pressure-actuated sleeve, which in turn undermines said temporary support and translates the collet with respect to said body.

8. The tool of claim 7, wherein:

said biased sleeve mounted to said body to allow sufficient translation of said body relative to said biased sleeve when said biased sleeve is engaged to the tubular, to allow said depressed surface to move adjacent said collet to facilitate release upon pressure-actuated movement of said movable sleeve.

9. The tool of claim 8, wherein:

said biased sleeve is biased by a coil spring to a lowermost position sufficiently close to said raised surface on said body such that said collet, after being retracted by action of said pressure-actuated sleeve, is trapped behind said biased sleeve;

said temporary support mounted on at least one shear pin to said body and supporting a collet spring which biases said collet beyond said lower end of said biased sleeve until said pressure-actuated sleeve moves and shears said pin, allowing said collet to retract and remain behind said biased sleeve.

10. A running tool for downhole tubulars, comprising:

a body;

a gripping member selectively engageable to grip the tubular and retain it whether the tubular is placed in tension or compression by said body;

a torque sleeve mounted to said body, having a lower end interengageable with the tubular for transmitting torque from said body directly to the tubular.

11. A running tool for downhole tubulars, comprising:

a body;

a gripping member selectively engageable to grip the tubular and retain it whether the tubular is placed in tension or compression by said body;

a torque sleeve mounted to said body, having a lower end interengageable with the tubular for transmitting torque from said body directly to the tubular;

a fluid-actuated defeating mechanism is operable on said gripping member to facilitate its release from the tubular;

whereupon actuation of said fluid-actuated defeating mechanism, said torque sleeve covers said gripping member to prevent reattachment to the tubular.

12. The tool of claim 11, wherein:

said defeating mechanism comprises a fluid-actuated piston which longitudinally retracts said gripping member within said torque sleeve;

said torque sleeve is biased in an opposite direction from the direction of retraction of said gripping member by a first spring supported by said body.

13. The tool of claim 12, wherein:

said gripping member comprises at least one collet biased by a second spring, said second spring bearing against a support selectively secured to said body;

said fluid-actuated piston undermines the secured support for said second spring and subsequently translates said collet to a position within said torque sleeve.

14. A running tool for downhole tubulars, comprising:

a body;

at least one collet for selectively retaining the tubular when tensile or compressive forces are placed on the tubular through said body;

a torque sleeve connected to the body and engaging the tubular in a different location than said collet for direct torque transfer from said body to the tubular without involvement of said collet.

15. A running tool for downhole tubulars, comprising:

a body;

at least one collet for selectively retaining the tubular when tensile or compressive forces are placed on the tubular through said body;

a torque sleeve connected to the body and engaging the tubular in a different location than said collet for direct torque transfer from said body to the tubular without involvement of said collet; and a pressure-actuated sleeve to selectively retract said collet within said torque sleeve, thus allowing release of the tubular by said body and preventing reengagement after said release.

16. The tool of claim 15, wherein:

said torque sleeve is biased from said body and mounted to said body in a manner to facilitate a range of relative motion therebetween;

said collet is biased toward a raised surface on said body from a temporary support from said body;

said collet remains trapped in a groove in the tubular by said raised surface throughout said range of relative movement which occurs between application of tensile force and application of compressive force through said body into the tubular.

17. The tool of claim 16, wherein:

said pressure-actuated sleeve undermines said temporary support by shearing a pin holding it to said body;

whereupon as a result of a setdown force applied to said body, a recessed surface presents itself adjacent said collet, which allows a retraction force applied to said collet by said pressure-actuated sleeve to retract said collet from the groove in the tubular and into said torque sleeve.

18. The tool of claim 17, wherein:

said pressure-actuated sleeve forms a variable-volume cavity between itself and said body with seals therebetween;

said body formed having a passage into said cavity and a means for creating pressure into said passage;

whereupon application of pressure to said cavity, said pressure-actuated sleeve moves to retract said collet, and said seals provide sufficient resistance to retain the weight of said collet, allowing said collet to remain with said torque sleeve.

* * * * *